US010696312B1

(12) United States Patent
Knight et al.

(10) Patent No.: US 10,696,312 B1
(45) Date of Patent: Jun. 30, 2020

(54) COVER APPARATUS FOR AN OPEN TOP CONTAINER SUCH AS A RAILCAR HOPPER

(71) Applicants: Steven J. Knight, Mission Hill, SD (US); Eric J. Turner, Yankton, SD (US)

(72) Inventors: Steven J. Knight, Mission Hill, SD (US); Eric J. Turner, Yankton, SD (US)

(73) Assignee: Shur-Co, LLC, Yankton, SD (US)

( * ) Notice: Subject to any disclaimer, the term of this patent is extended or adjusted under 35 U.S.C. 154(b) by 436 days.

(21) Appl. No.: 15/616,045

(22) Filed: Jun. 7, 2017

Related U.S. Application Data

(60) Provisional application No. 62/349,694, filed on Jun. 14, 2016.

(51) Int. Cl.
*B61D 39/00* (2006.01)

(52) U.S. Cl.
CPC ..... *B61D 39/007* (2013.01); *B61D 39/002* (2013.01); *B61D 39/001* (2013.01); *B61D 39/008* (2013.01)

(58) Field of Classification Search
CPC ..... B61D 39/002; B61D 39/007
USPC ..... 105/377.02, 377.04, 377.03
See application file for complete search history.

(56) References Cited

U.S. PATENT DOCUMENTS

| | | | | |
|---|---|---|---|---|
| 319,944 | A * | 6/1885 | Wyman | B61D 39/00 105/377.02 |
| 1,417,573 | A * | 5/1922 | Salata | B61D 39/002 105/377.02 |
| 7,823,515 | B2 | 11/2010 | Schaefer | |
| 7,967,363 | B2 | 6/2011 | Schaefer | |
| 8,631,746 | B2 | 1/2014 | Knight | |
| 8,826,827 | B1 | 9/2014 | Dimmer | |
| 2009/0159592 | A1* | 6/2009 | Vitalis | B65D 88/125 220/1.5 |
| 2016/0194010 | A1* | 7/2016 | Pettibone | B61D 39/002 105/377.09 |
| 2019/0118627 | A1* | 4/2019 | Arens | B60J 7/102 |

FOREIGN PATENT DOCUMENTS

| | | | | |
|---|---|---|---|---|
| WO | WO-2011070400 | A1 * | 6/2011 | B61D 39/002 |

* cited by examiner

*Primary Examiner* — Scott A Browne
(74) *Attorney, Agent, or Firm* — Jeffrey A. Proehl; Woods, Fuller, Schultz & Smith, PC

(57) ABSTRACT

A cover apparatus for selectively covering the open top of a container may include a pair of tracks for mounting on the sides of the container, a cover movably mounted on the pair of tracks. The cover may include a pair of cover assemblies movable toward each other to produce a closed condition and movable away from each other to produce an open condition. Each of the cover assemblies may be positionable at an end of the container and have a portion movable toward a center of the open top. A cover movement assembly may be configured to move the cover assemblies on the tracks toward each other into the closed condition and away from each other into the open condition.

13 Claims, 8 Drawing Sheets

COVER APPARATUS FOR AN OPEN TOP CONTAINER SUCH AS A RAILCAR HOPPER

REFERENCE TO RELATED APPLICATIONS

This application claims the priority of U.S. provisional application No. 62/349,694 filed Jun. 14, 2016, which is hereby incorporated by reference in its entirety.

BACKGROUND

Field

The present disclosure relates to tarping systems and more particularly pertains to a new cover apparatus for an open top container such as a railcar hopper.

SUMMARY

In one aspect, the present disclosure relates to a cover apparatus for selectively covering an open top of a container. The open top may be defined by an upper perimeter edge with opposite side portions and opposite end portions. The cover apparatus may comprise a pair of tracks configured for mounting on the container, with each said track being positionable adjacent to one of the side portions of the perimeter edge. The apparatus may comprise a cover movably mounted on the pair of tracks between a closed condition in which the cover apparatus substantially covers the open top and an open condition in which the cover apparatus does not substantially cover the open top. The cover may comprise a pair of cover assemblies, with the cover assemblies being movable toward each other to produce the closed condition and movable away from each other to produce the open condition. Each of the cover assemblies being positionable at a said end portion of the upper perimeter edge of the container and having a portion movable toward a center of the open top. The apparatus may include a cover movement assembly which is configured to move the cover assemblies on the tracks toward each other into the closed condition and away from each other into the open condition.

In another aspect, the disclosure relates to a system comprising a container having an open top defined by an upper perimeter edge, with the container having opposite sides and opposite ends and each of the side walls having a side portion of the upper perimeter edge and each of the end walls having an end portion of the upper perimeter edge. The system may also include a cover apparatus mounted on the container and configured to selectively cover the open top. The cover apparatus may comprise a pair of tracks mounted on the container, with each said track being positioned adjacent to one of the side portions of the perimeter edge. The cover apparatus may also comprise a cover movably mounted on the pair of tracks and movable between a closed condition in which the cover apparatus substantially covers the open top and an open condition in which the cover apparatus does not substantially cover the open top. The cover may comprise a pair of cover assemblies, with the cover assemblies moving toward each other to produce the closed condition and moving away from each other to produce the open condition. Each of the cover assemblies may be positioned at an end portion of the upper perimeter edge of the container and may have a portion movable toward a center of the open top. The apparatus may also include a cover movement assembly configured to move the cover assemblies on the tracks toward each other into the closed condition and away from each other into the open condition.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
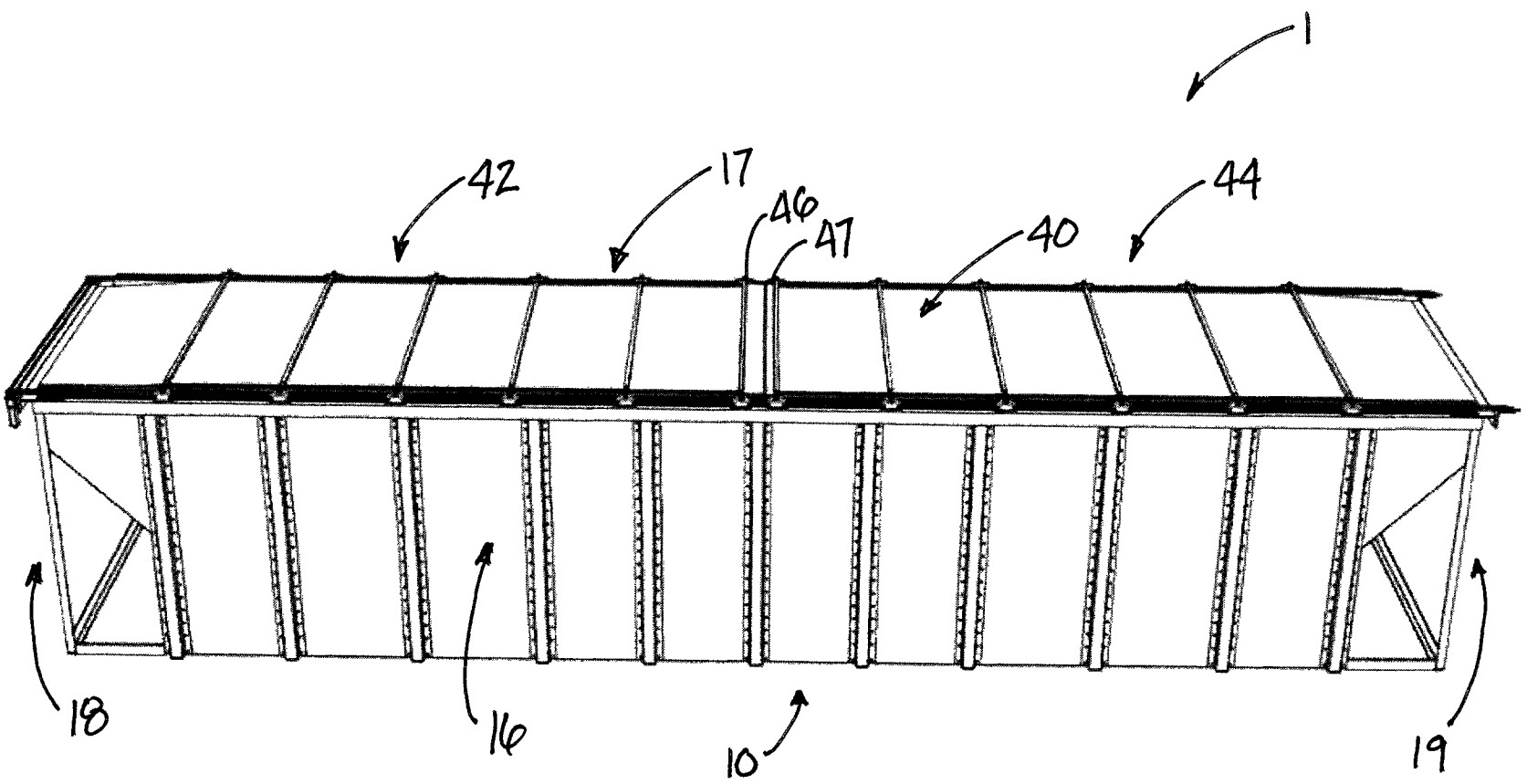
FIG. 1 is a schematic perspective view of a new cover apparatus mounted on the open top of the container of a railcar hopper, according to the present disclosure.
Figure 2:
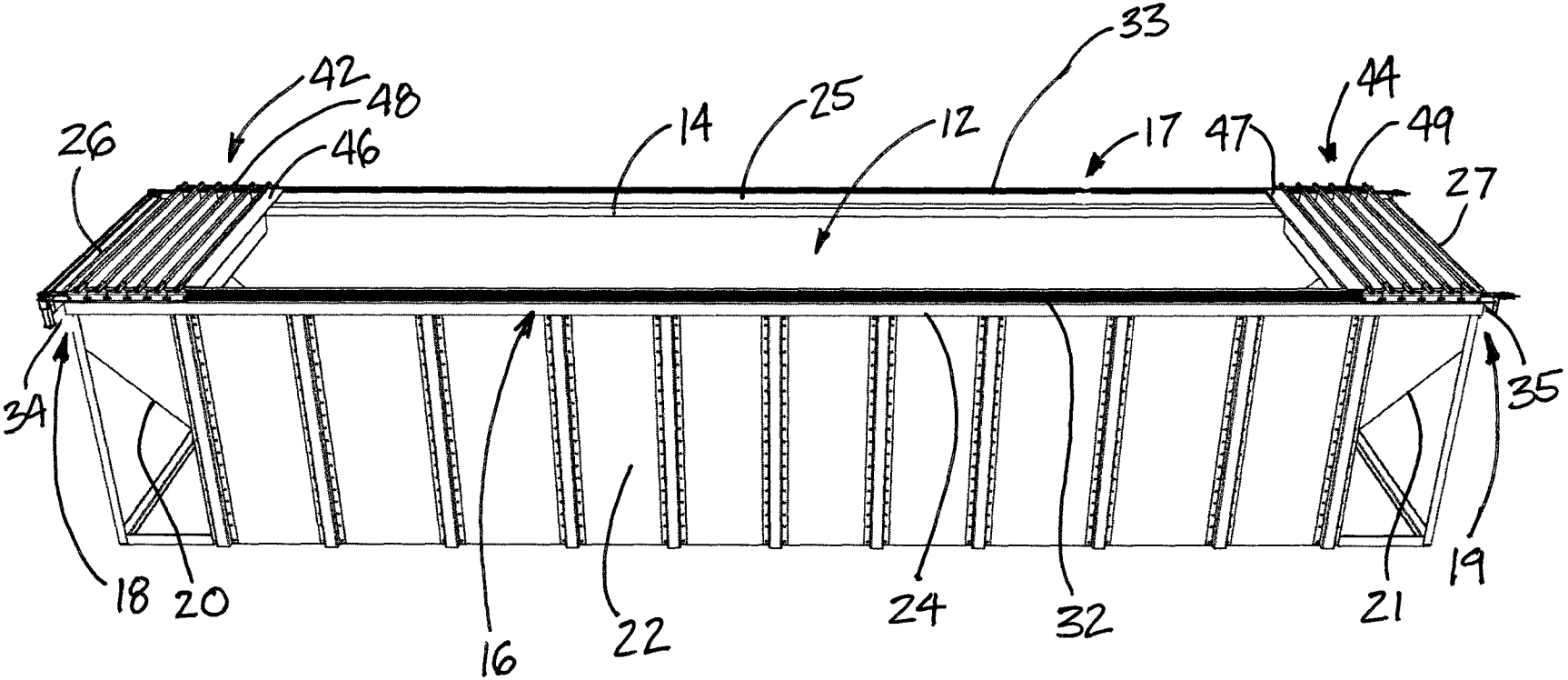
FIG. 2 is a schematic perspective view of the cover apparatus in an open condition on the open top of the container, according to the present disclosure.
Figure 3:
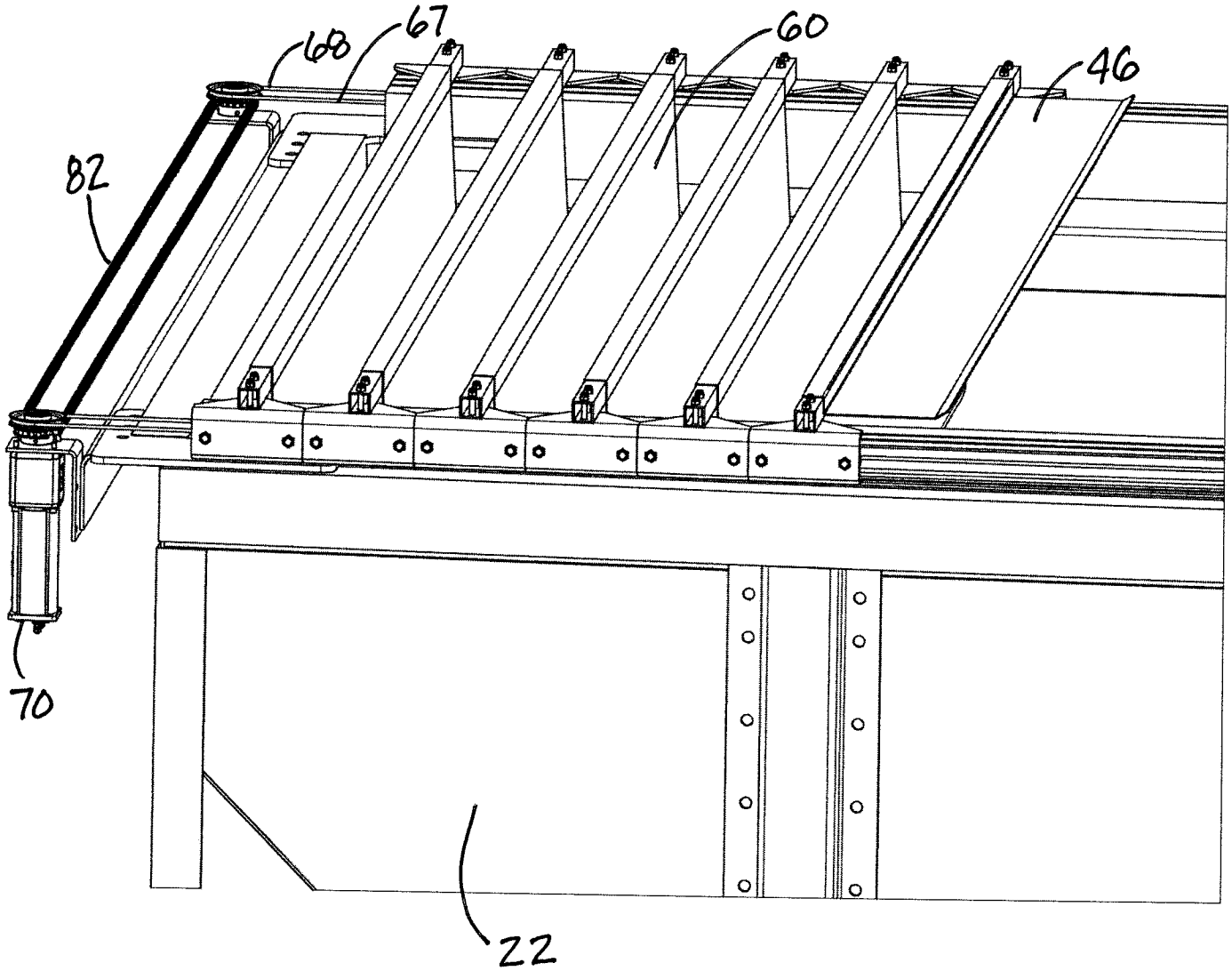
FIG. 3 is a schematic perspective view of a portion of the cover apparatus in the open condition, according to an illustrative embodiment.
Figure 4:
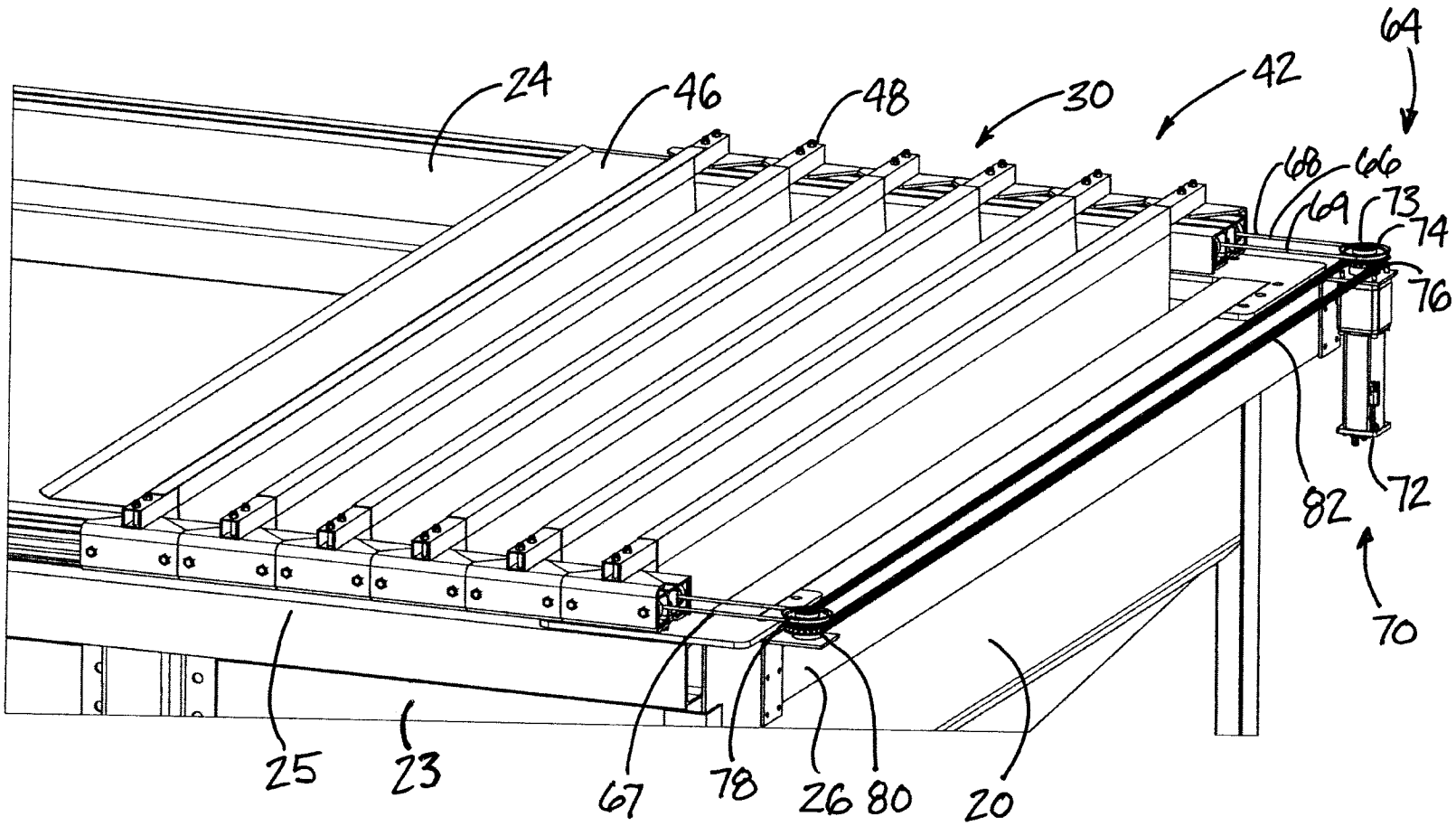
FIG. 4 is a schematic perspective view of the portion of the cover apparatus shown in FIG. 3 in the open condition and taken from a perspective opposite of the view in FIG. 3, according to an illustrative embodiment.
Figure 5:
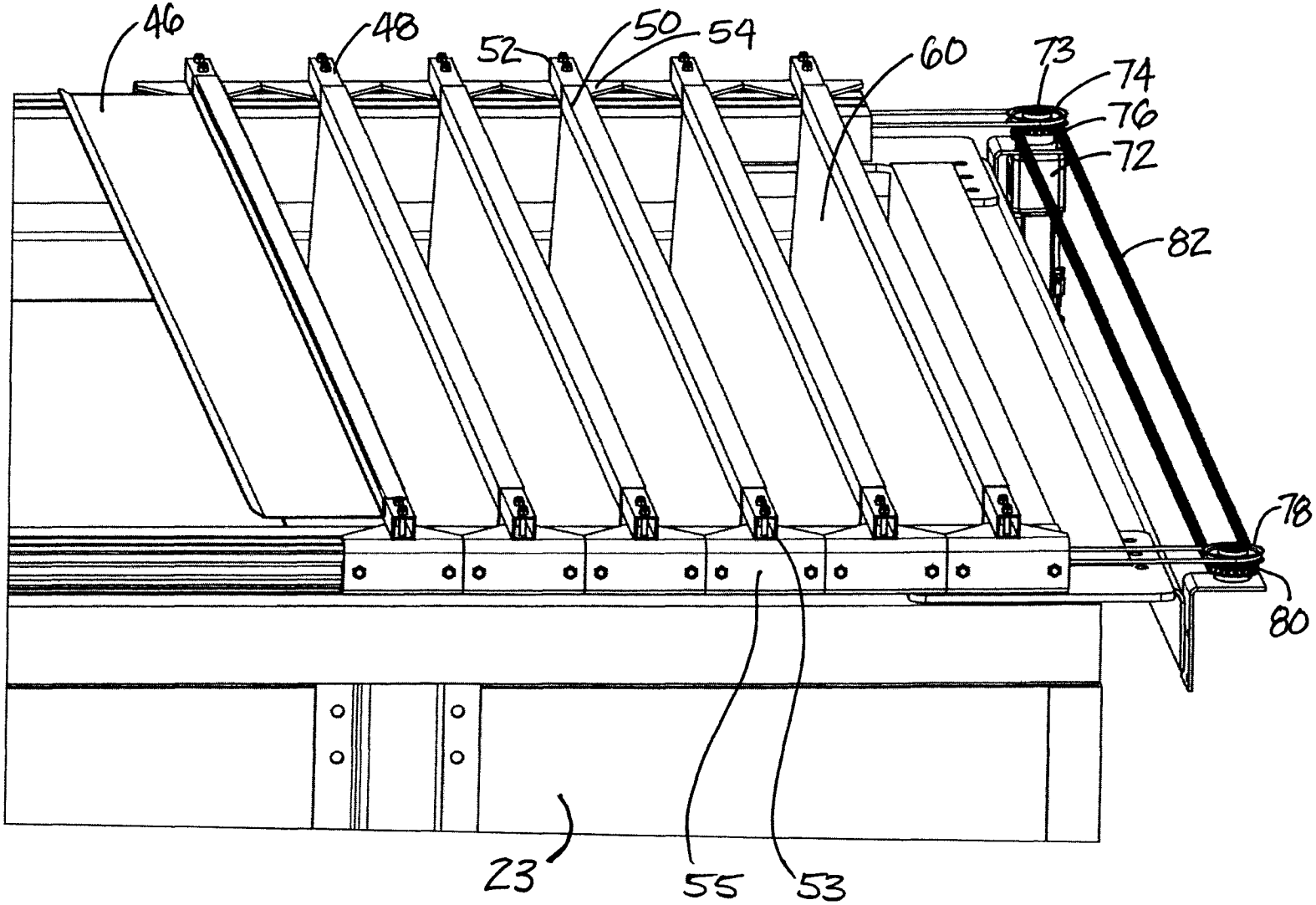
FIG. 5 is a schematic perspective view of the portion of the cover apparatus shown in FIG. 3, according to an illustrative embodiment.
Figure 6:
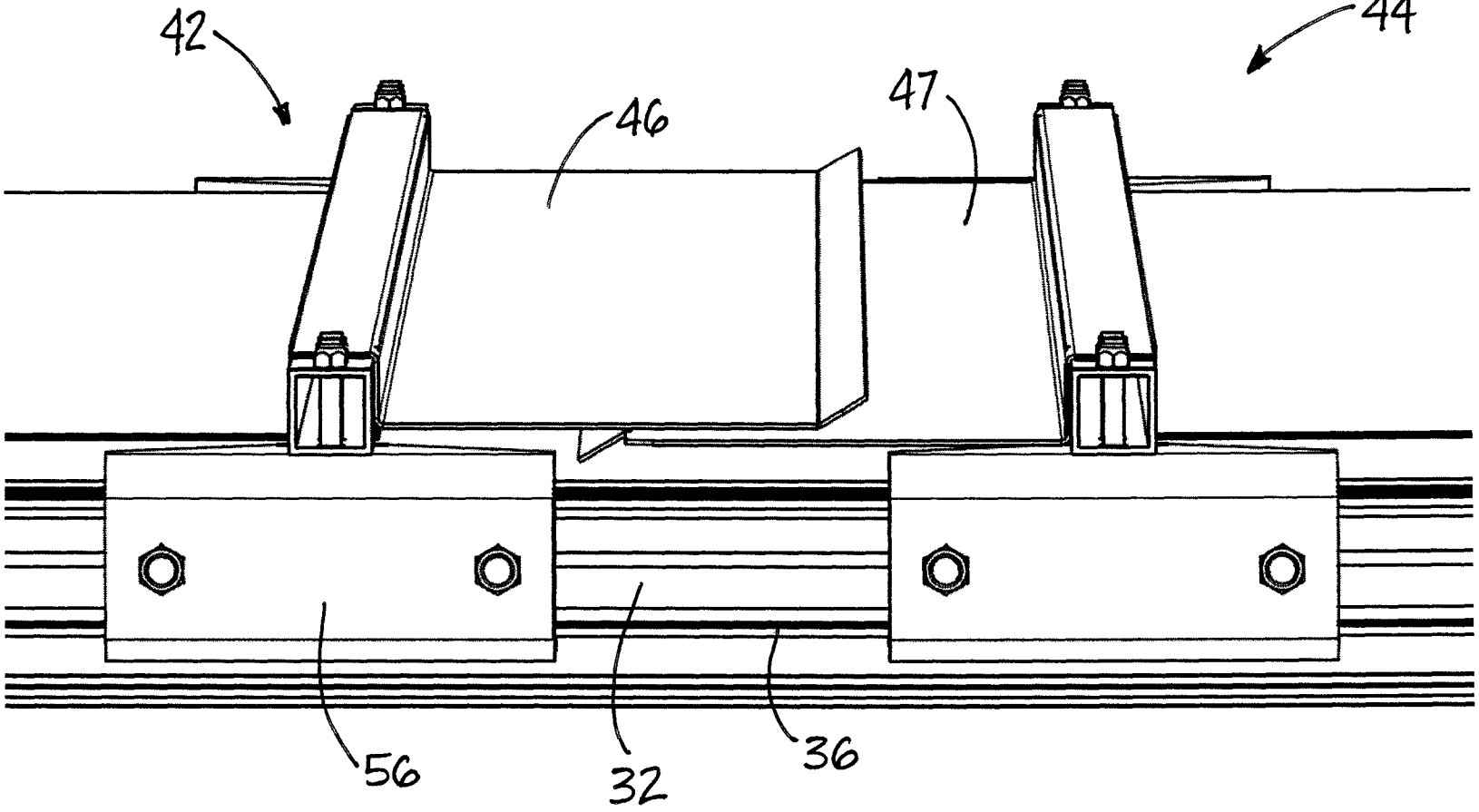
FIG. 6 is a schematic enlarged side perspective view of a portion of the cover apparatus in the closed condition, according to an illustrative embodiment.
Figure 7:
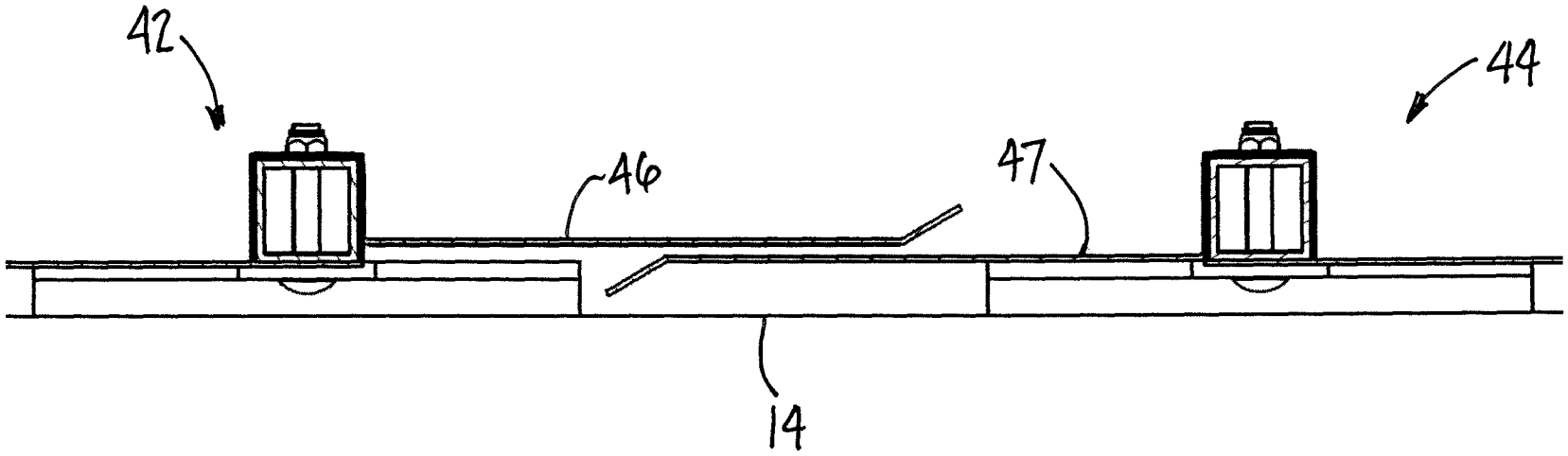
FIG. 7 is a schematic enlarged side view of the portion of the cover apparatus in the closed condition, according to an illustrative embodiment.
Figure 8:
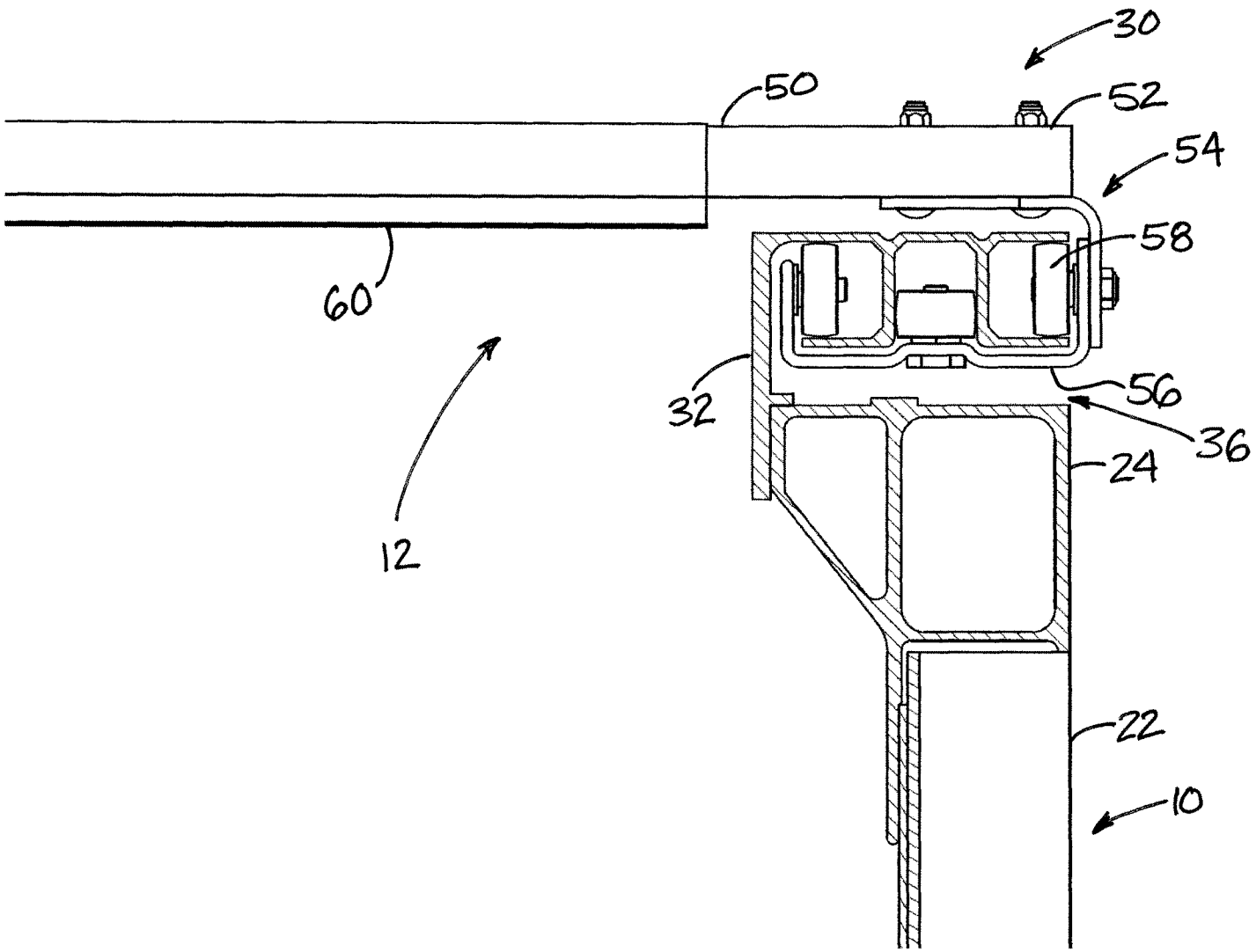
FIG. 8 is a schematic sectional view of a portion of an intermediate cover support and one of the tracks of the cover apparatus, according to an illustrative embodiment.

With reference now to the drawings, and in particular to FIGS. 1 through 8 thereof, a new cover apparatus for an open top container such as a railcar hopper embodying the principles and concepts of the disclosed subject matter will be described.

It has been recognized that the escape of a portion of the contents of a container, such as the hopper of a railcar, through the open top of the container is undesirable. Not only does the escape of the contents cause an economic loss of the product being shipped in the container, the character of the lost contents, usually a fine particle form driven out of the open top by wind, can litter and soil the area adjacent to the right-of-way which may have insidious effects other than just being unsightly. For example, coal dust escaping from open-top hopper railcars may land on the rock ballast used to support the ties of the railroad track, and the dust may gradually fill the spaces between the ballast. The presence of the coal dust in the ballast tends to hold moisture in the ballast that would otherwise drain away, and subsequent freezing of the moisture held in the ballast may cause displacement of the rock ballast. In turn, the rail ties may also be displaced, possibly resulting in damage to the position and integrity of the rails of the track, which may even lead to derailments of trains passing over the track.

Applicants have recognized that there have been many attempts to provide a suitable cover for hopper railcars that do not get in the way of loading or unloading the hopper, which in some cases may be inverted in order to unload the contents from the railcar Such attempts have ranged from the use of hard tops and flexible tops that pivot up and away from the open top of the hopper, as well as soft or flexible tarps that are unrolled into a closed condition over the open top and then rolled back into an open condition for loading and unloading. Most of these approaches have drawbacks, some significant, including the amount of time and effort or energy necessary to move the tops between opened and closed positions, as well as the need to access individual cars when movement of personnel along the right-of-way of the railroad track is generally disfavored. Due to the nature of the railcars, it is desirable to provide a cover that allows the railcar to remain as a self-contained unit without connection to a separate source of power. Powering the opening and closing of the closure system through solar-derived power is thus highly desirable for use in such applications, but the amount of power derived from solar is limited and is therefore not suitable to provide the higher amount of electrical power required to move heavy covers.

In one aspect, the disclosure relates to a system 1 including a container 10 with an open top 12 which may be defined by an upper perimeter edge 14 surrounding the opening of the open top. The container 10 may be elongated with opposite sides 16, 17 and opposite ends 18, 19 and generally the sides may be relatively longer and the ends may be relatively shorter. The container may be formed with a pair of side walls 22, 23 at the sides 16, 17 and a pair of end walls 20, 21 at the ends 18, 19. Each of the side walls may have a side portion 24, 25 of the upper perimeter edge 14 and each of the end walls may have an end portion 26, 27 of the upper perimeter edge. In the illustrative embodiments of this description, the container 10 comprises a hopper or other open top structure of a railcar, although it will be evident to those of ordinary skill in the art that aspects of the disclosure could be applied to containers other than a railcar hopper.

The disclosure also relates to a cover apparatus 30 for selectively covering the open top 12 of the container 10 and may be employed with or without the container in the system 1. The disclosure is thus not limited to embodiments in which the container 10 and cover apparatus 30 are integral with each other, and may comprise the cover apparatus 30 alone. The cover apparatus 30 may include a pair of tracks 32, 33 which are mounted on the container, with one of the tracks being mounted on each of the sides 16, 17 of the container. Each track 32, 33 may be positioned on one of the side walls 22, 23, and may be associated with the respective side portions 24, 25 of the upper perimeter edge 14 of the container, although positioning of the tracks adjacent to the portions of the upper perimeter edge may also be employed. Each of the tracks may have opposite ends 34, 35 which may be generally positioned adjacent to the opposite ends 18, 19 of the container when the tracks are mounted on the container.

In some embodiments, each of the tracks 32, 33 may have a substantially U-shaped configuration which may define a slot 36. The slots 36 of each of the tracks may be configured such that the slots open outwardly away from the open top 12 of the container when the tracks are mounted on the container. The outwardly opening configuration has the advantage of being relatively less likely to catch particles of the material being hauled in the container, particularly as the container is being loaded or unloaded.

The cover apparatus 30 may also include a cover 40 which may be movably mounted on the container, and may be movable on the tracks 32, 33 between a closed condition in which the cover apparatus is configured to substantially cover and close the open top of the container, and an open condition in which the cover apparatus is configured to not cover and not close a substantial portion of the open top of the container, although some portions of the open top may remain partially obstructed.

The cover 40 may include a pair of cover assemblies 42, 44 which may be configured to converge toward each other to produce the closed condition and may diverge away from each other to produce the open condition of the cover. Each of the cover assemblies 42, 44 may be positioned at one of the ends 18, 19 of the container and at least a portion of the cover assembly may be movable toward a center of the open top 12. A portion of each cover assembly may remain substantially stationary as a portion of the cover assembly moves to provide the open and closed conditions.

Each of the cover assemblies 42, 44 may include a lead cover support 46, 47 which may be mounted on the tracks 32, 33 to thereby bridge across the open top when the cover apparatus 30 is mounted on the container. The lead cover support 46 of one 42 of the cover assemblies may be configured to meet the lead cover support 47 of the other 44 of the cover assemblies in the closed condition of the cover 40. In some embodiments, the lead cover support of one of the cover assemblies may at least partially overlap a portion of the lead cover support of the other cover assembly in the closed condition to facilitate the closure of the open top of a container even when the cover assemblies do not fully extend toward the center of the open top, such as due to shrinkage, environmental temperature. The lead cover support may be positioned toward the center of the open top when the cover is in the closed condition, and may be positioned toward a respective end of the container when the cover is in the open condition. At least a portion of the lead cover support may extend into the respective slots 36 of the tracks 32, 33 to engage the tracks such that the tracks provide guidance to the movement of the lead cover supports.

Each of the cover assemblies 42, 44 may also include a plurality of intermediate cover supports 48 which are also mounted on the tracks 32, 33 to thereby bridge across the open top when the cover apparatus is mounted on the container. Each of the intermediate cover supports 48 may comprise a bow member 50 which may be elongated and extend from one track 32 to the other track 33 and thus from one side 16 of the container to the other side 17 of the container. The bow member 50 may have any suitable shape, such as a substantially straight and linear configuration, as well as an arched or elevated configuration for extending over container contents that may be heaped above the plane formed by the upper perimeter edge 14 of the container. The bow member 50 may have opposite ends 52, 53 which are positioned adjacent to tracks 32, 33 respectively. Each of the cover supports 48 may also include a pair of track mounts 54, 55 with each of the track mounts being mounted on one of the ends 52, 53 of the bow member. At least a portion of the track mount 54, 55 may extend into the slot 36 of the respective track. In some embodiments, each of the track mounts 54, 55 may have a mount plate 56 and one or more rollers 58 mounted on the mount plate. The roller or rollers 58 may be positioned in the track to engage the track and roll along the track as the intermediate cover support is moved along the track and along the open top of the container.

Each cover assembly 42, 44 may include a cover tarp 60 which is mounted on and extends across the cover supports of a respective cover assembly, and thus each cover assembly may have a separate cover tarp. The cover tarp 60 may be secured to the cover supports at intervals along the length of the cover tarp, with one end of the cover tarp being attached to the lead cover support and the opposite end of the cover tarp being secured to or at the respective end wall of the container when mounted on the container. Locations between the ends of the cover tarp may be attached to the intermediate cover supports, and the cover tarp may fold between adjacent cover supports when the cover apparatus is moved toward the open condition and may be stretched into an unfolded condition when the cover apparatus is moved toward the closed condition. The cover tarp 60 may be extended across the open top when the lead cover support 46 is moved toward the center of the tracks and the open top, and the cover tarp 60 may be retracted from the open top when the lead cover support is moved toward one of the ends of the container. The cover tarp may comprise a flexible sheet of material that may drape downwardly from the cover supports when the cover supports are moved toward the open condition of the cover.

The cover 40 may also include a cover movement assembly 64 which is configured to move the cover assemblies on the tracks and with respect to the open top when the cover apparatus is mounted on a container. The cover movement assembly 64 may be configured to move the cover assemblies toward each other into the closed condition and away from each other into the open condition of the cover. The cover movement assembly 64 may comprise a movement member 66, 67 which may extend along a respective one of the tracks 32, 33 to thereby extend along a respective side 16, 17 of the container. The cover movement assembly includes two movement members 66, 67, with a first movement member 66 being associated with the first track 32 and a second movement member 67 being associated with the second track 33. Each of the movement members may comprise or form a loop, and the loop may turn at each end 34, 35 of the track. Each movement member may thus have an outboard extent 68 which extends between the ends of the track and an inboard extent 69 which also extends between the ends of the track, and the extents may be oriented substantially parallel to each other. In some embodiments, the inboard extent may be located relatively closer to the open top and the outboard extent may be located relatively further away from the open top when the cover apparatus is mounted on a container, however other arrangements of the outboard and inboard extents may be utilized. Due to the looped nature of the movement member, movement of the outboard extent 68 in one direction along the track will be associated with movement of the inboard extent 69 in a substantially opposite direction along the track, and reversing the direction of movement of one extent will correspondingly reverse the direction of movement of the other extent.

The lead cover support 46 of the cover assembly 42 may be attached to the outboard extent 68 and the lead cover support 47 of the second cover assembly 44 may be attached to the inboard extent 69 of the movement member. Such a configuration will cause movement of the lead cover supports in substantially opposite directions when the loop of the movement member is caused to move. Movement of the lead cover supports toward the center of the length of the tracks tends to extend the cover tarp and toward the center, and also move the intermediate cover supports, which are attached to the cover tarp, toward the center without the intermediate cover supports being mounted on the movement member. Each movement member 66, 67 may be positioned in one of the respective tracks, such as within the U-shaped configuration of the track to provide a degree of protection for the movement member. In some embodiments, including the illustrative embodiments of the present disclosure, the movement member comprises a cable and the cable may be looped about suitable pulleys employed to form and support the elongated loop extending along the respective track.

The cover movement assembly 64 may also include a motor assembly 70 which is configured to move the movement member along the loop path and thus cause the movement of the outboard 68 and inboard 69 extents in substantially opposite directions. The motor assembly 70 may be positioned toward one of the ends of the track and illustratively the motor assemblies positioned adjacent to the end 34 of the first track 32. The motor assembly 70 may include a motor 72 with a rotatable shaft 73, and a drive pulley 74 may be mounted on the rotatable shaft on the motor, such that operation of the motor causes rotation of the drive pulley 74. The movement member 66 may be engaged with the drive pulley 74 such that rotation of the pulley 74 causes rotation of the loop of the movement member. The cover movement assembly 64 may also include a transfer assembly 76 which is configured to transfer rotation of the motor assembly 70 to the second movement member 67 associated with the second track 33. The transfer assembly 76 may include a driven pulley 78 which is positioned adjacent to the second track, and may be adjacent to one of the ends of the second track. The driven pulley 78 may engage the second movement member 67 such that rotation of the driven pulley causes rotation of the loop of the second movement member. The transfer assembly 76 may also include a transfer pulley 80 which may be mounted on the rotatable shaft 73 of the motor to be rotated with the drive pulley. A transfer member 82 may be configured to transfer rotation of the motor to the driven pulley 78, and the transfer member may engage the transfer pulley 80 and the driven pulley 78 to transfer rotation therebetween. The transfer member 82 may form a loop, such that the loop of the transfer member extends about the driven 78 and transfer 80 pulleys.

Optionally, the cover movement assembly 64 may utilize a manually operated crank handle, either alone to provide the sole means for operating the movement assembly, or in combination with the motor assembly 70 to provide a backup means for operating the movement assembly.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A cover apparatus for selectively covering an open top of a container, the open top being defined by an upper perimeter edge with opposite side portions and opposite end portions, the cover apparatus comprising:

a pair of tracks configured for mounting on the container, each said track being positionable adjacent to one of the side portions of the perimeter edge such that one track of the pair of tracks is positionable adjacent the first side portion and the other of the pair of tracks is positionable adjacent the second side portion;

a cover movably mounted on the pair of tracks and movable between a closed condition in which the cover apparatus substantially covers the open top and an open condition in which the cover apparatus does not substantially cover the open top, the cover comprising a pair of cover assemblies, the cover assemblies moving toward each other to produce the closed condition and moving away from each other to produce the open condition, each of the cover assemblies being positionable at one of the end portions of the upper perimeter edge of the container and having a portion movable toward a center of the open top; and a cover movement assembly configured to move the cover assemblies on the tracks toward each other into the closed condition and away from each other into the open condition wherein each of the cover assemblies comprises a plurality of cover supports movably mounted on the pair of tracks for extending across the open top when the apparatus is mounted on the container and a cover tarp mounted on and extending across the cover supports of the respective cover assembly; and wherein a movement member forms a loop, the loop turning at each end of the associated track, each movement member having an outboard extent extending between the ends of the track and an inboard extent extending between the ends of the track, at least one cover support of a first one of the cover assemblies being mounted to one of the extents and at least one cover support of a second one of the cover assemblies being mounted to another one of the extents.

2. The apparatus of claim 1 wherein the cover assemblies converge together to produce the closed condition and diverge away from each other to produce the open condition.

3. The apparatus of claim 1 wherein the cover movement assembly comprises a pair of the movement members, each movement member extending along at least one of the tracks for extending along one of the side portions of the upper perimeter of the container, an end of the cover supports of each cover assembly being mounted on the movement member such that movement of the movement member along the track moves the cover supports along the track.

4. The apparatus of claim 3 wherein each of the plurality of cover supports includes a lead cover support, the lead cover support of one of the first cover assembly being mounted to the outboard extent of the movement member and the lead cover support of the second cover assembly being mounted to the inboard extent of each of the movement members.

5. The apparatus of claim 4 wherein the lead cover support of one of the cover assemblies at least partially overlaps the lead cover support of an other one of the cover assemblies.

6. The apparatus of claim 3 wherein the movement member comprises a cable.

7. The apparatus of claim 3 wherein the movement member of the cover movement assembly is positioned in a respective one of the tracks.

8. The apparatus of claim 3 wherein the cover movement assembly comprises a motor assembly configured to move the movement member along the respective said track.

9. The apparatus of claim 8 wherein the cover movement assembly comprises a transfer assembly configured to transfer rotation of the motor assembly to a second said movement member associated with a second said track of the pair of tracks.

10. The apparatus of claim 1 wherein each of the tracks has a substantially U-shaped configuration with a slot opening, the tracks being configured such that the slot opening is directed outwardly when the track is mounted on the container.

11. A system comprising:

a container having an open top defined by an upper perimeter edge, the container having opposite sides and opposite ends, each of the side walls having a side portion of the upper perimeter edge and each of the end walls having an end portion of the upper perimeter edge;

a cover apparatus mounted on the container and configured to selectively cover the open top, the cover apparatus comprising:

a pair of tracks mounted on the container, each said track being positioned adjacent to one of the side portions of the perimeter edge such that one track of the pair of tracks is positionable adjacent the first side portion and the other of the pair of tracks is positionable adjacent the second side portion;

a cover movably mounted on the pair of tracks and movable between a closed condition in which the cover apparatus substantially covers the open top and an open condition in which the cover apparatus does not substantially cover the open top, the cover comprising a pair of cover assemblies, the cover assemblies moving toward each other to produce the closed condition and moving away from each other to produce the open condition, each of the cover assemblies being positioned at one of the end portions of the upper perimeter edge of the container and having a portion movable toward a center of the open top; and a cover movement assembly configured to move the cover assemblies on the tracks toward each other into the closed condition and away from each other into the open condition;

wherein each of the cover assemblies comprises a plurality of cover supports movably mounted on the pair of tracks to extend across the open top when the apparatus is mounted on the container and a cover tarp mounted on and extending across the cover supports of the respective cover assembly;

wherein the cover movement assembly comprises a movement member extending along at least one of the tracks to extend along a said side portion of the upper perimeter of the container, an end of the cover supports of each cover assembly being mounted on the movement member such that movement of the movement member along the track moves the cover supports along the track;

wherein the movement member forms a loop, the loop turning at each end of the associated track, each movement member having an outboard extent extending between the ends of the track and an inboard extent extending between the ends of the track, at least one cover support of a first one of the cover assemblies being mounted to one of the extents and at least one cover support of a second one of the cover assemblies being mounted to another one of the extents.

12. The system of claim 11 wherein the movement member comprises a cable.

13. The system of claim 11 wherein each of the tracks has a substantially U-shaped configuration with a slot opening, the tracks being configured such that the slot opening is directed outwardly from the open top of the container.

* * * * *